United States Patent [19]

Hartline, III

[11] 3,938,990

[45] Feb. 17, 1976

[54] METHOD OF MAKING CORROSION RESISTANT AUSTENITIC STEEL

[75] Inventor: Albert G. Hartline, III, Tarentum, Pa.

[73] Assignee: Allegheny Ludlum Industries, Inc., Pittsburgh, Pa.

[22] Filed: Sept. 5, 1974

[21] Appl. No.: 503,224

Related U.S. Application Data

[62] Division of Ser. No. 419,576, Nov. 28, 1973, Pat. No. 3,880,654.

[52] U.S. Cl. ..... 75/122; 75/128 A; 75/128 N

[51] Int. Cl.[2] ..... C22C 38/58

[58] Field of Search... 75/122, 128 N, 128 A, 128 C

[56] References Cited

UNITED STATES PATENTS

| | | | |
|---|---|---|---|
| 3,112,195 | 11/1963 | Souresny | 75/128 A UX |
| 3,592,634 | 7/1971 | Denhard | 75/128 A |
| 3,847,599 | 11/1974 | Hartline | 75/122 |

FOREIGN PATENTS OR APPLICATIONS

| | | | |
|---|---|---|---|
| 778,597 | 7/1957 | United Kingdom | 75/126 R |

*Primary Examiner*—L. Dewayne Rutledge
*Assistant Examiner*—Arthur J. Steiner
*Attorney, Agent, or Firm*—Vincent G. Gioia; Robert F. Dropkin

[57] ABSTRACT

A substantially non-porous, austenitic stainless steel that is resistant to chloride pitting and a method of making it are disclosed. The steel includes from 21–45% manganese, from 10–30% chromium, from 1–4% nickel, from 0.85–3% nitrogen, up to 2% silicon, up to 1% carbon and the balance iron and residuals. In addition to containing elements within the above-noted composition ranges, the alloys must be such that:

$$1.\ \%\,Cr + 0.8(\%Mn) - 11.8(\%N - 0.1) - 1.23(\%Ni) \quad 28.5$$

$$(2)\quad \frac{30(\%C + \%N) + 0.5(\%Mn) + \%Ni}{\%Cr + 1.5\,(\%Si)} \geqq 1.5$$

The steels are cast and worked to avoid a dwell period in the temperature range 1000°–1600°F.

1 Claim, 1 Drawing Figure

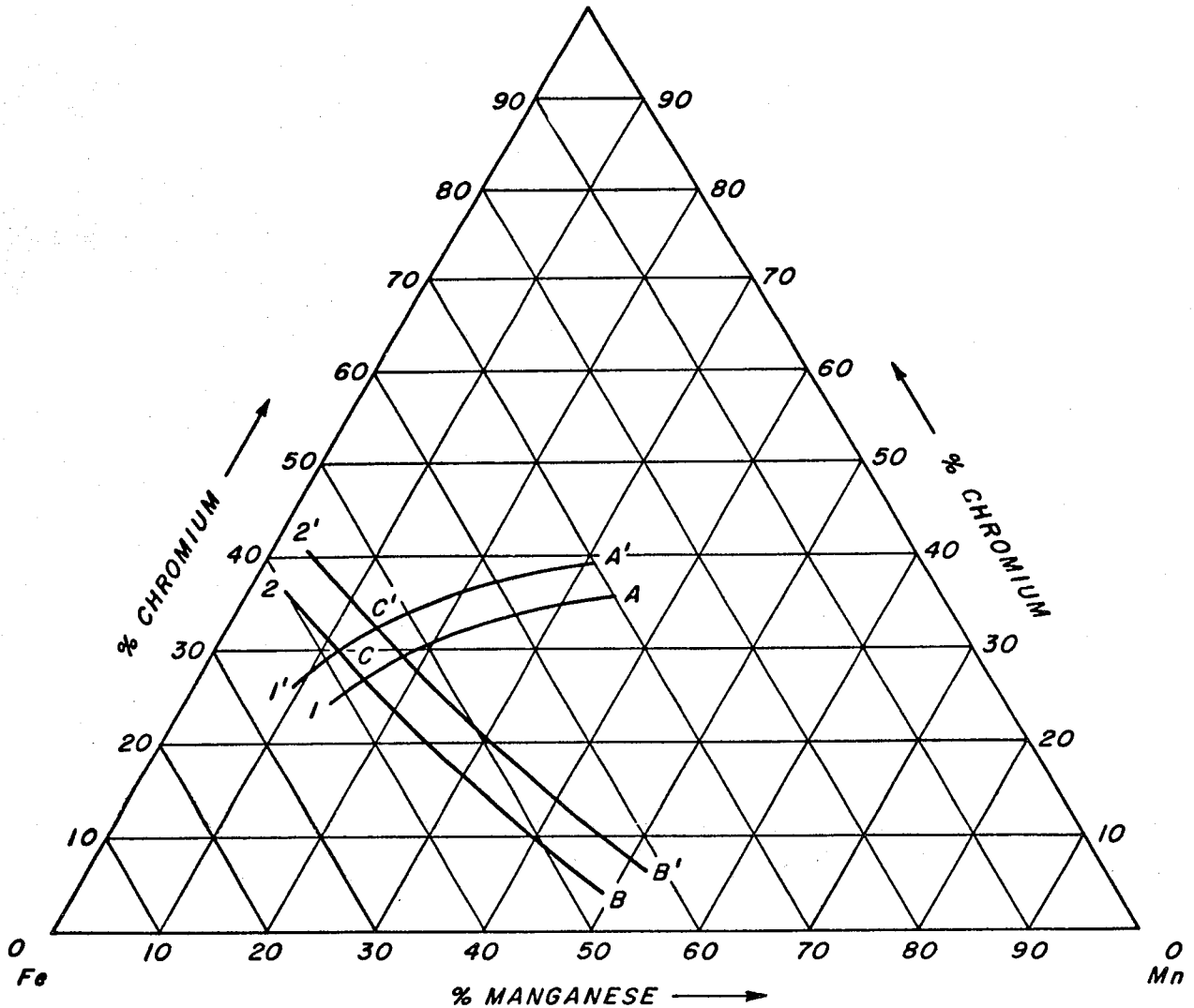
% CHROMIUM
% CHROMIUM
% MANGANESE
Mn
Fe
90
80
70
60
50
40
30
20
10
0
A'
A
B'
B
C'
C
1'
1
2'
2

METHOD OF MAKING CORROSION RESISTANT AUSTENITIC STEEL

This is a division of application Ser. No. 419,576, filed Nov. 28, 1973, now U.S. Pat. No. 3,880,654.

BACKGROUND OF THE INVENTION

Corrosion resistant steels, known as stainless steels, have long been known and are presently available with a variety of properties. Austenitic stainless steels, which are those consisting substantially of a single austenite phase, possess the best properties of corrosion resistance and good mechanical properties, particularly at high temperature. Austenitic stainless steels in the past have been steels in which chromium and nickel are the principal alloying agents. However, nickel is not an abundant metal, and the increased demand for it has increased its price and made its supply uncertain, particularly in critical times. Substitutes for nickel in the chromium-nickel austenitic stainless steels have long been sought. Recently the combined use of manganese, nitrogen and chromium in carefully balanced amounts has produced an austenitic stainless steel. This steel is described in U.S. patent application Ser. No. 251,637, filed May 8, 1972; and although it is an excellent steel, it is somewhat subject to attack by chloride environments.

SUMMARY OF THE INVENTION

The present invention is a chromium-manganese-nitrogen steel containing a small but critical amount of nickel. The steel of this invention is substantially nonporous, austenitic and highly resistant to attack by chloride environments. The alloy of this invention contains from 21–45% manganese, from 10–30% chromium, from 1–4% nickel, from 0.85–3% nitrogen, up to 2% silicon, up to 1% carbon and the balance iron and residuals. All compositions in this specificication and the following claims are in percent by weight of the total composition unless otherwise specified.

In addition to the foregoing ranges, the composition of the alloys must be balanced in accordance with the following equations:

$$(1)\quad \%Cr + \frac{0.8(\%Mn)}{28.5} - 11.8(\%N - 0.1) - 1.23(\%Ni)$$

$$(2)\quad \frac{30\,(\%C + \%N) + 0.5\,(\%Mn) + \%Ni}{\%Cr + 1.5\,(\%Si)} \quad 1.5$$

In the alloys of the present invention, chromium must be present to produce the same effect that it does in prior art alloys. The alloys of this invention must contain from 10–30% chromium. At least 10% chromium is required to give the steel its outstanding corrosion resistance. Chromium also has a secondary effect upon the strength of the steel and is a primary element in increasing the steel's solubility for nitrogen. An upper limit of 30% chromium is imposed as chromium is a ferrite former and excessive amounts of ferrite might form with higher chromium levels and in turn degrade the properties of the steel. A preferred chromium content is in the range of 15–27% in that steels containing this range of chromium are easy to process while still having good corrosion resistance and strength.

The manganese in the alloy of this invention is present in amounts of from 21–45%. Since manganese is an austenitizer and increases the solubility of nitrogen in the steel, amounts in excess of 21% are required. An upper limit of 45%, and preferably an upper limit of 30%, manganese is imposed for economic considerations and because manganese tends to attack furnace refractories.

Nitrogen, a strong austenitizer, should be present in the steel in amounts of from 0.85–3%. At least 0.85% is required for its austenitizing effect and because it is the primary strengthening element of the steel. Amounts of nitrogen in excess of 3% tend to yield porous ingots which are not satisfactory. The nitrogen content of the alloy of this invention preferably is from 1.05–1.5%.

The nickel content of the alloy of this invention must be between 1% and 4%. Although nickel has long been known as an element of stainless steels, it has been used in substantially larger quantities and not in nitrogen-containing alloys. When more than 4% nickel is present in these alloys, nitrogen gas evolves during solidification, producing porous ingots which cannot be usefully worked. However, alloys containing from 1–4% nickel show a marked improvement in resistance to pitting in chloride environments and do not produce porous ingots.

Carbon, of course, is a well-known austenitizer and strengthener for steels and is employed in the alloys of this invention in amounts up to 1%. The concentration of carbon must be maintained below that level in that larger amounts can remove chromium from solid solution by combining with it to form chromium carbides and because carbon can reduce the solubility of the steel for nitrogen by occupying interstitial sites normally filled with nitrogen. It is preferred that less than 0.15% carbon be present in the alloy of this invention. Higher carbon contents require higher annealing temperatures to put carbon into solution.

The alloys of the present invention may tolerate silicon concentrations as high as 2% but preferably the silicon is below 1%. Higher quantities of silicon tend to remove manganese from the alloy in the form of manganese silicates and tend to form inclusions in the steel.

Although the residuals in the iron need not be identified and do not significantly affect the properties of the alloy, the usual residuals may be identified as phosphorus, sulfur, copper, molybdenum, tungsten and cobalt.

Since the stainless steel composition of this invention is desirably a substantially one-phase austenitic material, thermal treatments that tend to precipitate other phases should be avoided. Although the alloys of this invention are not particularly sensitive to precipitation of other phases, the method of preparation employed should avoid long dwell periods in the 1000°–1600°F temperature range. Long dwell periods would be characterized by furnace cooling. For ordinary thicknesses air cooling or quenching are sufficient to carry the alloy through the 1000–1600°F range quickly enough to avoid precipitation of detrimental phases such as sigma phase.

DETAILED DESCRIPTION OF THE INVENTION

The accompanying drawing illustrates two plots of the 1.0% nitrogen section of the iron-chromium-manganese-nitrogen quaternary phase diagram. One plot illustrates that section wherein the alloy contains only residual amounts of nickel while the other plot illustrates that section containing 4% nickel.

As indicated in equations (1) and (2) set forth above, nickel has a significant effect both on the austenitic structure of the alloy and on the ability of the alloy to maintain nitrogen in solution both in the liquid phase and in the resultant solid phase. Within the composition limits set forth herein nickel could be used to replace manganese, carbon and nitrogen in equation (2), but nickel additions require supplementary additions of chromium and manganese in equation (1). In the drawing the area above line 1-A and 1'-A' generally represents compositions where a two-phase alloy of austenite and ferrite exists, and these lines are defined by equation (1). As mentioned above, this two-phase system is undesirable because it does not have the good mechanical or chemical properties of a single-phase austenitic alloy. The area below the lines 1-A and 1'-A' are single-phase austenitic alloys.

Equation (2) defines the lines 2-B and 2'-B'. The area below these lines represents compositions where nitrogen comes out of solution during solidification and creates porous ingots. The areas above the lines 2-B and 2'-B' is where nitrogen remains in solution during solidification and non-porous ingots are formed.

The areas A'-C'-B' and A-C-B therefore represent the areas in which the alloys of this invention and of the prior art fall for this particular cross section of the quaternary phase diagrams illustrated. The alloys of the present invention fall in the area A'-C'-B'. It may be noted that a single-phase alloy having no porosity may be obtained with moderate additions of chromium and manganese in accordance with the present invention.

To demonstrate the benefits of this invention, five alloys were prepared having compositions set forth in Table I.

TABLE I

| ELEMENT | PERCENT WEIGHT | | | | |
|---|---|---|---|---|---|
| | ALLOY 1 | ALLOY 2 | ALLOY 3 | ALLOY 4 | ALLOY 5 |
| Mn | 30.40 | 29.70 | 29.99 | 29.88 | 29.80 |
| Cr | 20.45 | 20.11 | 20.34 | 20.20 | 20.52 |
| N | 1.00 | 1.09 | 1.10 | 1.15 | 1.02 |
| Ni | 0.26 | 0.85 | 2.00 | 3.15 | 4.19 |
| Cu | 0.20 | 0.17 | 0.16 | 0.17 | 0.16 |
| Si | 0.48 | 0.50 | 0.50 | 0.41 | 0.44 |
| C | 0.092 | 0.065 | 0.064 | 0.064 | 0.065 |
| Mo | 0.033 | 0.015 | 0.015 | 0.010 | 0.012 |
| S | 0.009 | 0.011 | 0.010 | 0.009 | 0.010 |
| P | 0.014 | 0.008 | 0.006 | 0.007 | 0.008 |

The alloys of Table I are substantially the same as each other with the exception of the nickel content. In effect, the alloys are all nominally 30% manganese, 20% chromium, 1% nitrogen alloys containing respectively a residual amount, 1%, 2%, 3% and 4% nickel.

The alloys described in Table I were all prepared in the same way. All alloys were prepared from melted materials in an air induction furnace and were composited of commercial grades of ferroalloys and pure elements. The heats were cast from approximately 2650°F into 35 pound cast iron ingot molds. After solidification, the ingots were examined for porosity which was not observed in any of the alloys except Alloy 5 which was too porous to be rolled. The hot processing of Alloy 1 through Alloy 4 inclusive consisted of grinding to remove casting imperfections, heating the ingots at 2250°F for an appropriate amount of time and hot rolling to the desired width and thickness. All ingots from Alloy 1 through Alloy 4 were rolled without incident. The hot rolled materials were annealed at 1950°F on a schedule of 120 minutes per inch of material thickness, subsequently blasted and pickled in a mixture of 15% nitric acid and 3% hydrofluoric acid, cold rolled 50% to further homogenize the structure, final annealed at 1950°F on the same schedule as mentioned above and again pickled. At various stages of the processing, samples were obtained to determine the mechanical properties of the metals. These properties are set forth in Table II. The strength data were obtained after annealing for 7 minutes at 1950°F because this treatment produces a condition of minimum strength and maximum ductility in all alloys so that truly comparative data are obtained. It may be noted that the addition of 1% nickel increases the strength of an alloy such as Alloy 1, but further additions of nickel, up to 3%, have no significant effect on strength.

TABLE II

| Tensile Properties As Annealed | Alloy Number 1 | 2 | 3 | 4 |
|---|---|---|---|---|
| 0.2% Yield Strength (ksi) | | | | |
| Longitudinal | 97.5–99.2 | 103.8–105.7 | 103.7–105.6 | 101.2 |
| Transverse | 98.2–100.5 | 106.8–107.0 | 105.2–105.8 | 103.7–106.0 |
| Ultimate Tensile Strength (ksi) | | | | |
| Longitudinal | 146.1–146.4 | 149.5–150.4 | 149.4–151.9 | 149.0 |
| Transverse | 147.7–149.2 | 153.5–153.6 | 153.9–154.1 | 153.5–153.9 |
| Elongation | | | | |
| Longitudinal | 50–52 | 46.5–47.0 | 46.5–50.0 | 50.0 |
| Transverse | 45–50 | 45.5–46.5 | 46.0–47.0 | 45.5–47.0 |
| Hardness, Rockwell C | 28 | 29 | 28–29 | 28.5 |

The alloys of this invention are resistant to pitting attack in chloride environments. The resistance to pitting attack was measured in a crevice corrosion test wherein standardized specimens of the various alloys were immersed in 10% ferric chloride solution for 72 hours. The pitting attack was measured by the mean weight loss of a number of samples of each alloy. The resistance of the alloys of the present invention to chloride pitting are set forth in Table III.

TABLE III

| | Alloy 1 | Alloy 2 | Alloy 3 | Alloy 4 |
|---|---|---|---|---|
| Nickel Content (%) | 0.26 | 0.85 | 2.00 | 3.15 |
| Mean Weight Loss (grams) | 1.101 | 0.116 | 0.137 | 0.151 |

The potentiokinetic technique is another method for measuring the pitting resistance of an alloy to chloride solutions. In this technique an alloy specimen is placed in contact with an appropriate chloride solution and an electrical potential is imposed on the specimen at increasing voltages until a breakthrough point at which a surge of current passes through the solution. Higher breakthrough potentials indicate greater resistance to chloride pitting. A significant aspect of the potentiokinetic technique is that the ability of an alloy to self-passivate may be found by reversing the potential to determine where a high resistance to current flow is obtained after the breakthrough. Alloys with a tendancy to self-passivate display a decrease in current at a voltage near the breakthrough potential. Alloys 2, 3 and 4 all showed better resistance to chloride pitting in potentiokinetic tests than did Alloy 1. Of equal significance is that Alloys 2, 3 and 4 all showed better self-passivation properties when the potential on the specimens was reduced than did Alloy 1.

What is claimed is:

1. A method for producing a substantially nonporous austenitic stainless steel which comprises compositing an alloy consisting essentially of about 21–45% manganese, about 10–30% chromium, about 1–4% nickel, about 0.85–3% nitrogen, up to 1% carbon, up to 2% silicon, and the balance iron and residuals, wherein the composition is such that:

$$1.\ \%Cr + 0.8(\%Mn) - 11.8(\%N - 0.1) - 1.23(\%Ni) = 28.5$$

$$(2)\quad \frac{30\,(\%C + \%N) + 0.5\,(\%Mn) + \%Ni}{\%Cr + 1.5\,(\%Si)} = 1.5$$

melting said materials to form a homogeneous liquid phase and solidifying the resultant liquid phase by air cooling or quenching in the temperature range from about 1000°–1600°F.

* * * * *